United States Patent [19]

Seifert et al.

[11] 4,081,147

[45] Mar. 28, 1978

[54] REVERSIBLE DISK REFINER PLATES

[75] Inventors: Peter Seifert; David E. Chupka; Lynn L. Getz; Derald R. Hatton; R. Marvin Thomas; John M. Osso; Herbert A. Rogl, all of Middletown, Ohio

[73] Assignee: The Black Clawson Company, Middletown, Ohio

[21] Appl. No.: 690,548

[22] Filed: May 27, 1976

[51] Int. Cl.[2] ..... B02C 7/12

[52] U.S. Cl. ..... 241/261.3; 241/297

[58] Field of Search ..... 241/261.2, 261.3, 296, 241/297, 298

[56] References Cited

U.S. PATENT DOCUMENTS

| | | | |
|---|---|---|---|
| 122,129 | 12/1871 | Myers | 241/297 |
| 248,509 | 10/1881 | Schmeja | 241/297 X |
| 1,123,494 | 1/1915 | Craig | 241/297 X |
| 1,369,685 | 2/1921 | Malony | 241/297 X |
| 3,289,954 | 12/1966 | Jones | 241/298 |
| 3,326,480 | 6/1967 | Jones | 241/298 |

*Primary Examiner*—Roy Lake
*Assistant Examiner*—Howard N. Goldberg
*Attorney, Agent, or Firm*—Biebel, French & Nauman

[57] ABSTRACT

Refining plates for disk-type refiners are manufactured with a working surface on each side thereof so that they can be turned over for reuse after one working surface has worn away. Special provision is made for mounting these plates to protect the unused working surfaces while preventing bypass flow of stock through the grooves in each working surface which is not being used, and also to compensate for a worn-out working surface when the other side of the plate is being used. Identical plates may be used on both stator and rotor; alternatively, a double-sided rotor plate can be used in combination with a hub on which it is mounted for replacement whenever the stator plates are turned over or replaced.

2 Claims, 14 Drawing Figures

REVERSIBLE DISK REFINER PLATES

BACKGROUND OF THE INVENTION

Cellulosic fibers such as paper pulp, bagasse, insulation or fiber board materials, cotton and the like, are commonly subjected to a refining operation which consists of mechanically rubbing the fiber between sets of relatively rotating bar and groove elements. In a disk-type refiner, these elements commonly consist of plates having annularly arranged bar and groove patterns defining their working surfaces, with the bars and grooves extending generally radially of the axis of the rotating element, or more often at an angle to a radius to the center of the annular pattern, so that the stock can work its way from the center of the pattern to its outer periphery.

Disk-refiners are commonly manufactured in both single and twin disk types. In the former, the working surface of the rotor comprises an annular refiner plate, or a set of segmental refiner plates, for cooperative working action with a complementary working surface on the stator which also comprises an annular plate or a series of segmental plates forming an annulus. In a twin disk refiner, the rotor is provided with working surfaces on both sides which cooperate with a pair of opposed complementary working surfaces on the stator, with these working surfaces being of the same type of construction as with a single disk refiner. In both types of refiners, the refiner plates are expendable and must be replaced when their working pattern of bars is worn away.

SUMMARY OF THE INVENTION

The present invention has as its primary objective the provision of refiner plates which are initially manufactured with working surfaces on both sides so that when one surface has been worn down, the plates can be turned over to present a fresh working surface. It is therefore also essential to accomplishment of this objective to make it possible to mount the refiner plates so that they are equally effective when both working surfaces are new as well as when one surface has been worn away and the plates have been reversed.

Refiner plates in accordance with the invention for mounting on the stator of a disk-refiner are accordingly manufactured as an annular plate, or a series of segmental plates, having identical working surfaces composed of alternating bars and grooves arranged in the desired pattern on both sides thereof.

In one form of this invention, each plate surface includes inner and outer concentric annular locating grooves, and the plate is mounted on the stator by means of lugs which preferably comprise inner and outer concentric annular flanges which fit into the locating grooves in the refiner plate. The proportions of these parts are predetermined so that when a new plate, or set of segmental plates, is installed, the spare working surface is supported out of contact with any of the structure except the mounting flanges. When the working surface on one side has been worn away, this flange and groove arrangement is equally effective for mounting an annular plate or set of segmental plates with the other working surface in proper working position.

In another form of the invention, the locating grooves and flanges are omitted, and the refiner plate is mounted in face to face engagement with its mounting seat on the stator. Bolt holes are provided in the plate in suitable positions for mounting the plate with either surface exposed. If the worn surface of a plate is out of parallel with the still unused working surface of the plate, it is ground to accurate parallelism before it is remounted for use of its still unused surface. In both forms of the invention, special provision is made to block the grooves in each unused working surface against bypass flow of stock therethrough.

The principles of the invention are equally applicable to the rotor, and similar reversible plates may be mounted on one or both sides of a rotor disk by either of the arrangements just described for the stator. In an alternate construction for a twin-disk refiner, the rotor is fabricated as a hub on which is mounted a replaceable annular refiner plate having working surfaces on both sides thereof. With either arrangement, in a twin-disk refiner, four sets of working surfaces are obtained with one half as many refiner plates as with conventional constructions.

These and other objectives of the invention will in part be apparent and in part be pointed out in the course of the detailed description of preferred embodiments of the invention.

DESCRIPTION OF THE PREFERRED EMBODIMENTS

Figure 1:
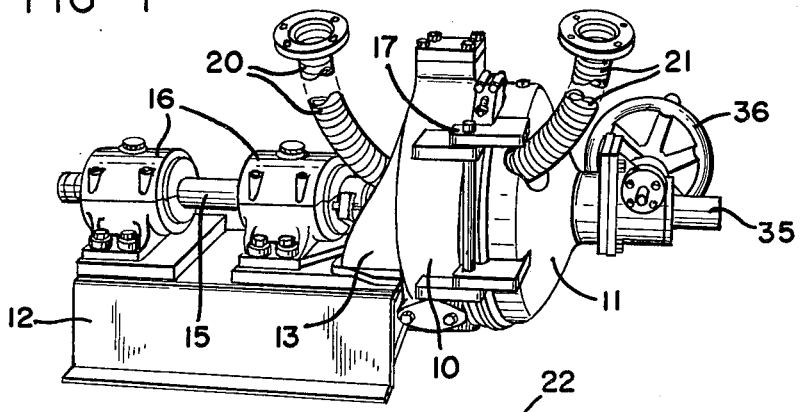
FIG. 1 is a perspective view of a typical twin-disk refiner in which the invention is applicable.

In the typical twin-disk refiner shown in FIG. 1, the two housings 10 and 11 which enclose the working parts are mounted in overhung relation with the base 12, the inner stator housing 10 being mounted by a bracket 13, and the drive shaft 15 being supported in bearing assemblies 16 mounted on the top of base 12. The outer stator housing 11 has a hinged mounting 17 on the inner stator housing 10 to provide a ready access to the working parts for the purpose of changing refiner plates. Each of housings 10 and 11 incorporates an inlet port 20 or 21, and the inner housing 10 also incorporates the outlet port 22 from the refining chamber defined by the two housings in closed position.

The rotor 25 is mounted by its hub 26 on the end of drive shaft 15 within the refining chamber, and the shaft 15 is mounted for sufficient axial movement in its bearing assemblies 16 to provide for automatic self-centering of rotor 25 between the opposing stator faces 30–31. The stator face 30 is a part of the inner housing 10, but the stator face 31 is part of a head 33 mounted for axial movement in housing 11 by means of a sliding key 34 under the control of a lead screw 35 operated by a drive illustrated as a hand wheel 36 on housing 11 to adjust the spacing of the opposing faces 30–31 in accordance with the worn conditions of the refiner plates.

Figure 2:
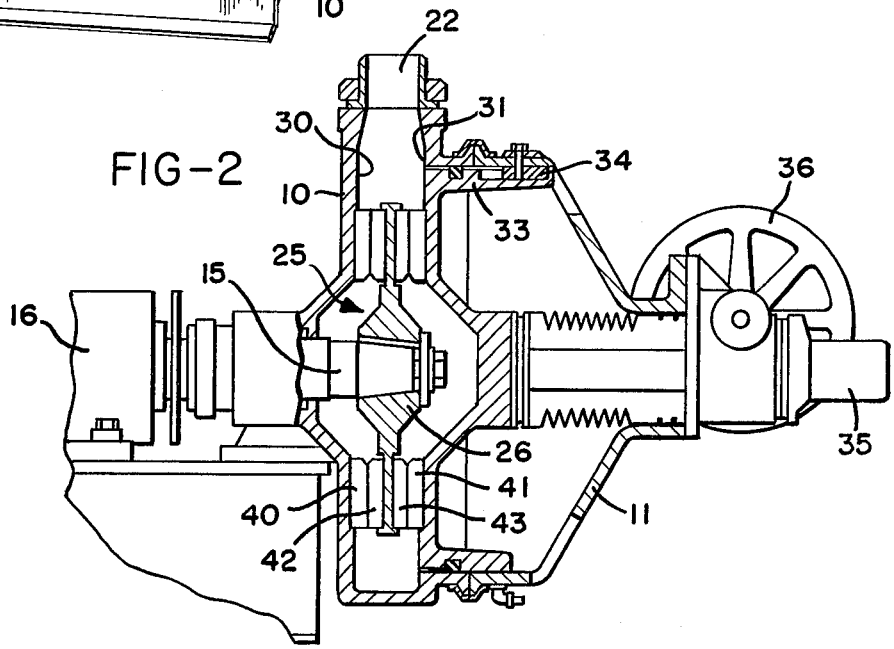
FIG. 2 is a fragementary axial section showing a conventional assembly of stator and rotor refiner plates in the refiner of FIG. 1.

In the conventional construction shown in FIG. 2, an annular refiner plate 40, 41, or an annular set of segmental refiner plates, is mounted on each of the stator faces 30 and 31, and a similar refiner plate 42, 43 or annular set of refiner plates is mounted on each side of rotor 25. Then after the housing 11 has been closed, the head 33 is adjusted to a position wherein the opposed faces of all of these refiner plates have the proper running clearance, and the refiner will be already for operation. As the working surfaces of the refiner plates 40–43 wear down, the head 33 will be adjusted inwardly until the refiner plates are completely worn down and must be replaced.

In the conventional construction, each of the refiner plates 40–43 has a working surface on only one side, with the reverse side being blank and for mounting purposes only. Therefore when a set of refiner plates has been worn down, they are scrap and must all be replaced. The purpose of the present invention is to provide refiner plates which initially have a working surface on each side thereof, and also to provide means for mounting such refiner plates on the stator and/or the rotor so that their exposed working surfaces are equally effective whether their other surfaces are worn away or yet unused.

Figure 3:
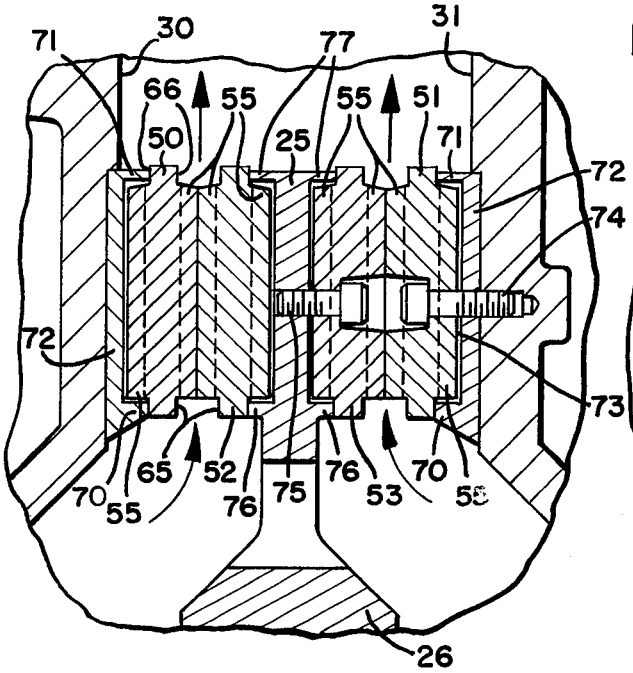
FIG. 3 is a fragmentary axial section similar to FIG. 2 and showing one embodiment of the invention with all the refiner plates new.
Figure 4:
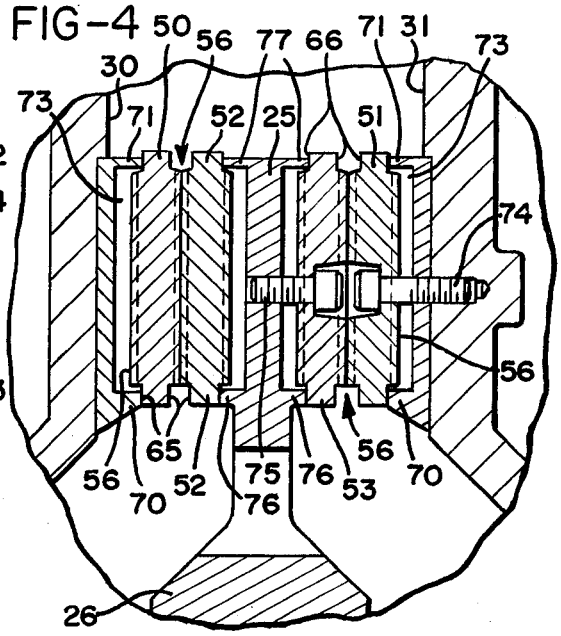
FIG. 4 is a view similar to FIG. 3 showing all the refiner plates substantially worn out and ready for replacement.

Referring to FIG. 3, the refiner plates 50 and 51 in accordance with the invention are mounted on the opposed stator faces 30 and 31, and the identical refiner plates 52 and 53 are mounted on opposite sides of rotor 25. FIG. 3 illustrates these parts as new, with working surfaces 55 on each side thereof, and FIG. 4 shows the same parts after both sets of working surfaces on each of the refiner plates 50–53 have been worn away, as indicated at 56.

Figure 5:
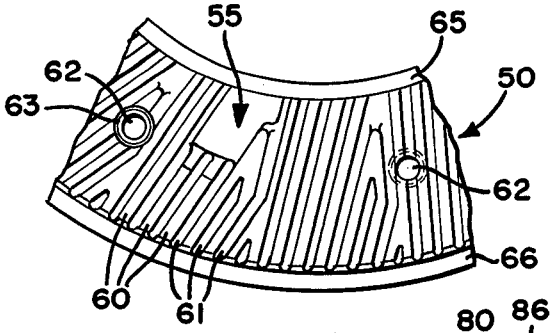
FIG. 5 is a fragmentary elevation showing one of the working surfaces of one of the refiner plates of FIG. 3.

FIG. 5 shows a fragment of the working surface 55 of one of the refiner plates 50–53, indicated as plate 50. It should again be noted at this point that the refiner plates 50–53 are shown as annular because they are easy to mount and exchange in an overhung refiner of the type shown in FIG. 1 For the more conventional type of refiner wherein the working parts are located generally centrally of the machine, such as shown in Herbert et al. U.S. Pat. No. 3,552,664, it is preferred to use an annular set of segmental refiner plates, but otherwise the principles are the same and the description of one herein is applicable to both.

The working surface 55 on each side of refiner plate 50 in FIG. 5 consists primarily of a pattern of alternate working grooves 60 and bars 61 running generally tangentially with respect to the central axis of plate 50. The particular pattern is immaterial to the invention, the pattern shown in FIG. 5 is only for illustration, and the term "bars" is used herein to apply equally to elongated bar members as shown at 61 and to similar projections of any shape conventionally used in disk refiners. The plate 50 is also provided with a plurality of holes 62 for mounting screws, adjacent holes being counterbored at 63 on alternate sides of the plate for mounting with either working surface 55 exposed.

In addition to the working grooves 60, each working surface 55 includes a pair of inner and outer concentric cylindrical grooves 65 and 66 which are slightly deeper than the working grooves 60, e.g., 0.31 inch and 0.25 inch respectively. These locating grooves 65–66 cooperate with lug means on the stator or rotor to mount the respective mounting plates in reversible working condition, as now described.

The mounting lugs for the stator plates 50–51 comprise a pair of inner and outer cylindrical flanges 70 and 71 on an annular spacer plate 72 mounted on each of the opposing stator faces 30–31. These flanges 70–71 define an annular pocket 73 therebetween and are proportioned and spaced to be received in the respective locating grooves 65–66 on one of the refiner plates 50 or 51 and to support the unused working surface thereof out of contact with the bottom of pocket 73. Preferred results have been obtained in this respect with the locating grooves of the dimension noted above when the axial dimension of each of flanges 70 and 71 is 0.38 inch, and it is important that the axial dimensions of the locating grooves and flanges match accurately in order to assure that the cooperating working surfaces of the respective plates are maintained in parallel relation.

It will be noted that the flanges also effectively block off both sets of ends of the grooves 60 in the unused working surface 55 to prevent by-passing of unrefined stock therethrough. In addition, the holes 62 which are not being used for mounting screws are preferably plugged to prevent access of stock to the pockets 73 where it might sour, and this is readily done by dummy bolts or removable plastic or wooden plug means, such as a removable epoxy filler, on both the rotor and stator plates. The refiner plates 50–51 and the cooperating spacer plates 72 are clamped to stator faces 30–31 by bolts 74, and when the exposed working surfaces of these refiner plates have been worn away, it is merely necessary to reverse the plates and thereby to expose their unused surfaces. This condition is represented in FIG. 4, which shows that the flanges 70–71 cooperate with the locating grooves 65–66 equally and when the working bars 61 have been virtually worn away.

The refiner plates 52–53 on the rotor 25 are individually identical with refiner plate 50. They are mounted on the rotor by means of screws 75 and a pair of inner and outer cylindrical flanges 76–77 of the same spacing and axial dimension as the flanges 70–71, and which provide the same groove-blocking function. The initial mounting and subsequent reversal of the rotor plates will therefore be the same as the stator plates, as is illustrated by comparison of FIGS. 3 and 4. It will also be apparent that flanges 70–71 could similarly be cast integrally with the stator faces 30–31 respectively, but the use of separate spacer plates 72 facilitates application of the invention to refiners of conventional construction.

Figure 6:
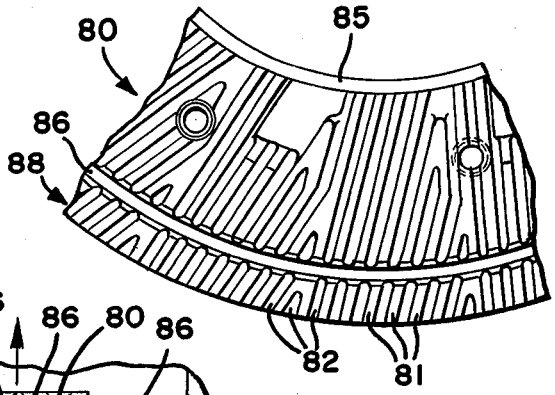
FIG. 6 is a view similar to FIG. 5 showing a larger diameter refiner plate usable in the assembly of FIGS. 3 and 4.

FIG. 6 shows a segment of a refiner plate 80 which is of greater outer diameter than the refiner plate 50, but which can be used in the same refiner and utilizing the same mounting means on the stator or rotor. The working surface of plate 80 comprises a similar arrangement of working grooves 81 and bars 82, and it is also provided with locating grooves 85–86 identical in size and location with the grooves 65–66 on plate 50, the only difference being that the working surface of plate 80 also extends radially beyond the outer locating grooves 86. These two sizes of refiner plates are readily made with an outer diameter difference of two inches for use interchangeably in the same refiner.

Figure 7:
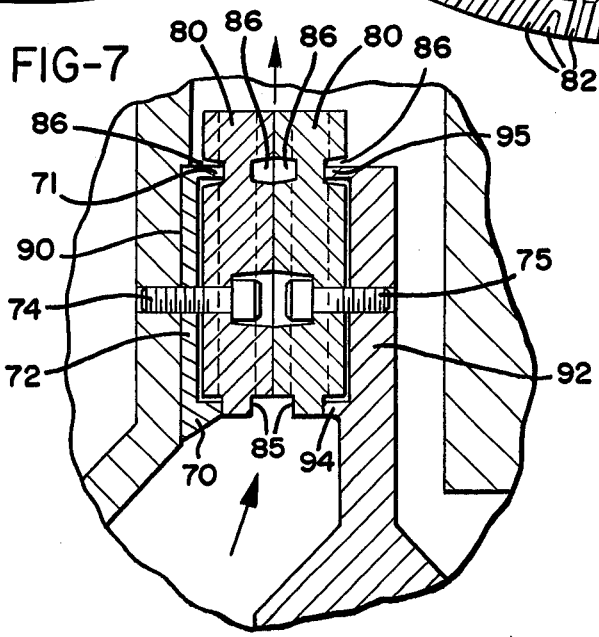
FIG. 7 is a view similar to FIG. 3 illustrating the use of the refiner plate of FIG. 6 in a single-disk refiner.

FIG. 7 illustrates the use of two refiner plates 80 in a single disk refiner. The stator plate 80 is shown as mounted on the stator face 90 by means of a spacer plate 72 and bolts 74 in the same way as the stator plates in FIG. 3, but with the outer portion 88 of its working surface extending radially beyond the outer flange 71. The second plate 80 is similarly mounted on the rotor 92 by means of bolts 75 and cylindrical flanges 94–95 of the same dimensions and locations as flanges 76–77 in FIGS. 3 and 4. Reversal of these refiner plates is accomplished in the same manner as described in connection with FIGS. 3 and 4.

Figure 8:
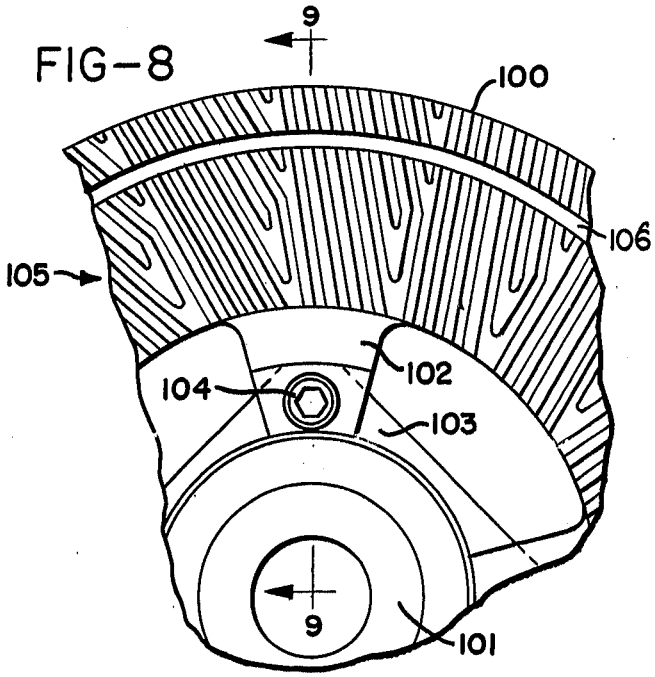
FIG. 8 is a fragmentary view of a rotor hub and the working surface of a double-sided rotor plate constituting another embodiment of the invention.
Figure 9:
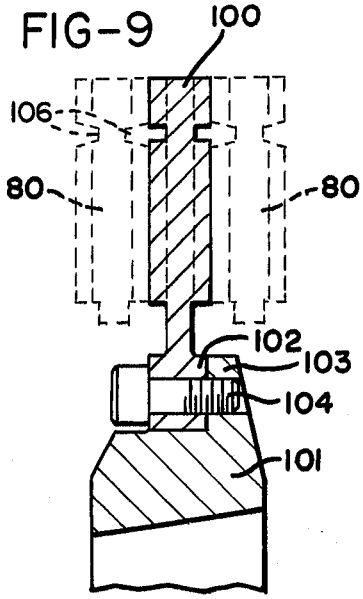
FIG. 9 is a section on the line 9—9 of FIG. 8.

FIGS. 8 and 9 show another form of rotor assembly in accordance with the invention wherein the working portion is an expendible annular plate 100 having a working surface on each side thereof. This plate 100 is mounted on the rotor hub 101 by integral lug portions 102 which mate with flange portions 103 of the hub and are secured thereto by screws 104. The working surface 105 of plate 100 is shown as of the same pattern as the refiner plates 80 previously described, including grooves 106 matching the locating grooves 86 in each plate 80. This rotor plate 100 is accordingly intended to be used in a twin-disk refiner with a pair of reversible stator plates 80 as shown in FIG. 9, and when the stator plates are worn to the point of requiring reversal or replacement, the plate 100 will similarly be replaced with a duplicate such plate. A similar two-sided rotor plate for use with stator plate 50 would be of the same construction as plate 100 except that its radial dimension should be the same as the radial distance between the locating grooves 65 and 66 in each plate 50.

Figure 10:
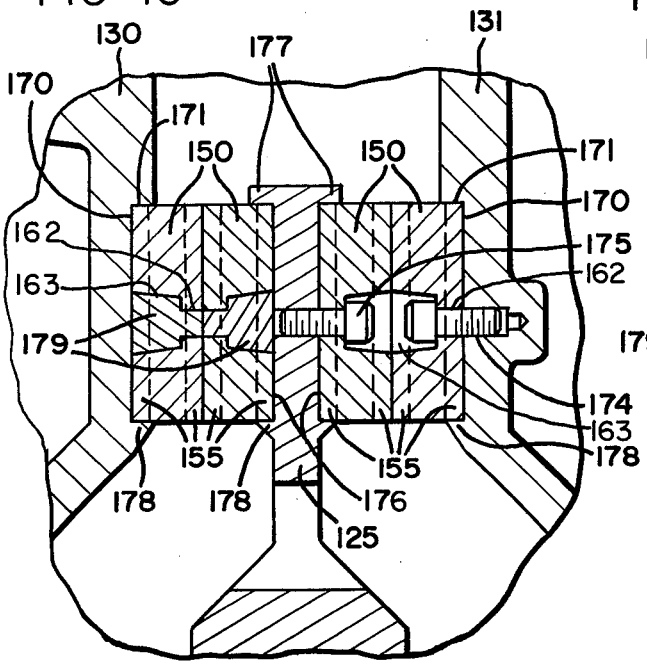
FIG. 10 is a sectional view similar to FIG. 3 showing a modified form of reversible refiner plate and the mounting therefor in accordance with the invention.

FIGS. 10–13 show another form of reversible refiner plate in accordance with the invention wherein each plate is mounted in face to face engagement with the stator or rotor instead of having its working or worn out surface spaced from the adjacent face of the stator or rotor whereon it is mounted. in FIG. 10, the rotor 125 corresponds to rotor 25, and the stator faces 130 and 131 correspond to faces 30 and 31 but are not equipped with spacers like spacer plates 72.

Each refiner plate 150 has a working surface 155 of bars and grooves similar to the working surface 55 but not provided with locating grooves like grooves 65–66. Each refiner plate 150 is provided with an even number of holes 162 for mounting screws 174 or 175, and adjacent holes 162 have counterbores 163 on opposite sides of plate 150. Each refiner plate 150 is shown in FIG. 10 as a new plate clamped to a stator face 130 or 131 or one of the faces or rotor 125 by screws 174 or 175 with one working surface 155 in face to face engagement with the seat provided by the face of the stator or rotor, and with its other working surface exposed for use.

The stator faces 130 and 131 are relieved to form seats 170 for the plates 150 which terminate at their outer peripheries in shoulders 171, and preferred results are obtained with the shoulders 171 dimensioned to overlap and close the outer ends of the grooves in the unused working surfaces 155 and thereby to prevent stock from bypassing the working zones between cooperating plates on the stator and rotor. A similar seat 176 for a plate 150 is provided on each side of rotor 125 by a peripheral flange 177 which is dimensioned similarly to the shoulders 171, for the same purpose.

This shoulder or flange arrangement provides particularly convenient means for preventing bypassing of the working zones by way of a working surface which has not yet been used, and it is also desirable to provide a similar shoulder or flange 178 for closing the radially inner ends of the grooves in working surfaces 155. Other means could be used for the same purpose, such as a temporary filler for the grooves or a removable band around the periphery of a working surface which is not being used. In addition, FIG. 10 shows at 179 a temporary plug in an unused bolt hole 162 to block access of stock to the unused working surface 155.

Figure 11:
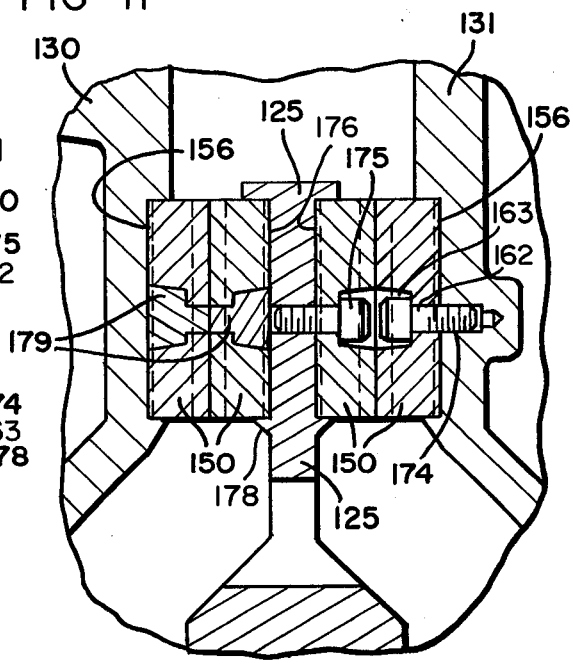
FIG. 11 is a view similar to FIG. 4 showing the refiner plates of FIG. 10 in reversed position after one surface on each thereof has been worn away.

FIG. 11 shows the same parts as FIG. 10 after the working surface on each refiner plate 150 has been worn away and the plates have been reversed. The worn surface 156 of each plate is accordingly in face to face engagement with its mounting seat on the face of the stator or rotor, and the mounting screws 174–175 occupy the other set of holes 162 in each refiner plate.

Figure 12:
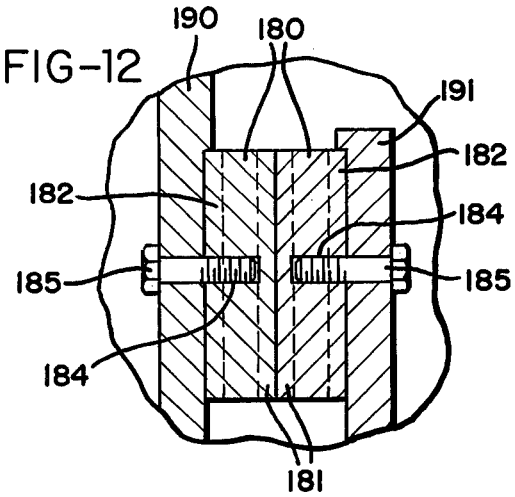
FIG. 12 is a sectional view similar to FIG. 7 showing another modified form of reusable refiner plate of the invention and the mounting therefor.
Figure 13:
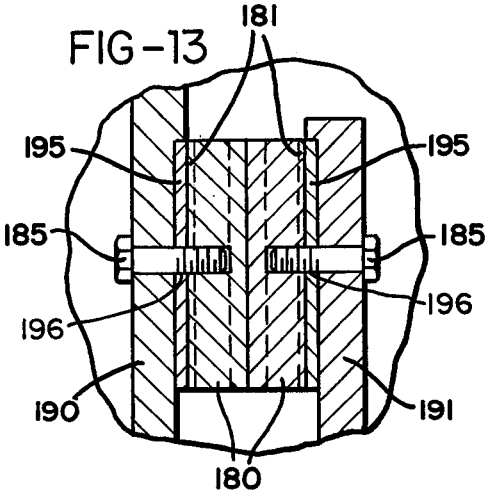
FIG. 13 is a view similar to FIG. 12 and showing the plates of FIG. 12 reused after one surface on each thereof has been worn away.

In some cases, the adjustability of the stator of a twin-disk refiner, or the shaft of a single-disk refiner, may be insufficient to compensate for the wear of the disks after reversal as illustrated by comparison of FIGS. 10 and 11. In such cases, the invention can be practiced as shown in FIGS. 12–13, wherein each of the refiner plates 180 has working surfaces 181 and 182 and is of essentially the same construction as the plates 150 except that instead of counterbored bolt holes, each plate 180 is provided with a plurality of through holes 184 which are tapped to receive mounting screws 185. These mounting screws extend through the adjacent wall of the stator 190 or rotor 191, and since all the holes 185 are usable at the same time, there is no reason to plug any of them as with the counterbored holes in the other plates described above.

FIG. 13 represents the condition when the plates 180 have been reversed after their working surfaces 181 have been substantially worn away. In order to compensate for the worn material, a complementary spacer plate 195 is positioned between each refiner plate 180 and the adjacent rotor or stator wall surface. These spacer plates are provided with through holes 196 through which the mounting screws 185 pass to engage in the tapped holes 184 in the refiner plates.

It will be apparent that the tapped mounting hole arrangement for the plates 180 could be used for any of the other refining plates already described, and particularly for plates constructed for use with spacers 72 so long as the refiner in which they are to be used is of such construction as to allow for the use of mounting screws in the manner shown in FIG. 12, as would be the case in FIG. 7. Similarly spacer plates 195 could be used with reversed plates 150 in the arrangement shown in FIG. 11.

It is important in the embodiments of FIGS. 10–13 that the reversed refiner plates have their opposing working surface in accurately parallel relation, having in mind that during the period of use of the first set of working surfaces, the wear may be uneven to the point of providing a worn surface which is inclined at an angle to the face of the still unused working surface. This condition is readily taken care of by grinding the worn surface to parallel relation with its opposite unused surface.

Figure 14:
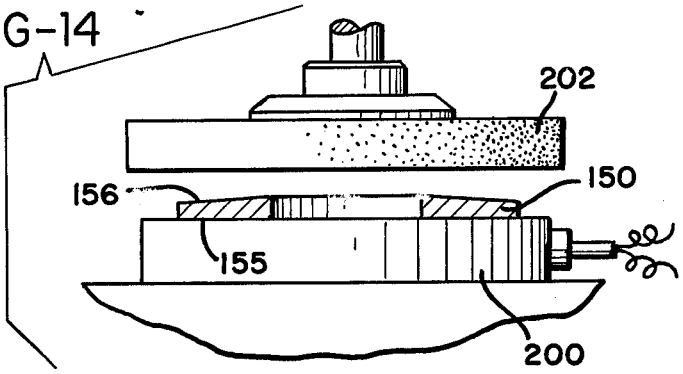
FIG. 14 is a somewhat diagrammatic view illustrating the grinding of the worn surface of one of the refiner plates of FIGS. 10–12 preparatory to replacing it in a refiner.

FIG. 14 illustrates this result as being accomplished by mounting a refiner plate 150 with its unused working surface 155 held on a magnetic holding plate 200 while its worn surface 156 is ground down by a grinding disk 202 until all devation from parallelism with surface 155 has been corrected. This plate 150 can then be mounted with its surface 156 positioned as shown in FIG. 11 with assurance that its working surface 155 will be accurately parallel with the working surface of its complementary refiner plate on the stator or rotor. Similar grinding treatments may be needed with the plates 180 in FIGS. 12–13. Working time for the refiner will be saved if worn plates are initially replaced by a new or previously reconditioned set of plates, which in turn can be replaced, when their exposed surfaces have worn out, by the reground previously removed plates.

It will be apparent that the plate construction and mounting arrangements shown in FIGS. 10–13 can be adapted to different combinations of rotor and stator, including a single disk refiner as shown in FIG. 7 and also in conjunction with a two-sided rotor disk as shown in FIGS. 8 and 9. Similarly, there are no theoretical limits on the size of the refiner plates in accordance with FIGS. 10–13.

The invention accordingly offers distinct advantages of convenience and economy over conventional practice. Each of the double-sided refiner plates can be produced from stock only slightly thicker than the stock normally required for a conventional refiner plate, and the cost of its production with working surfaces on both sides is no more than slightly greater for a single sided plate. This provides significant economies from the standpoint of initial material and production costs, with the result that the user is able to obtain two sets of working surfaces at far lower cost than for two sets of conventional single-sided plates.

While the forms of apparatus herein described constitute preferred embodiments of the invention, it is to be understood that the invention is not limited to these precise forms of apparatus, and that changes may be made herein without departing from the scope of the invention which is defined in the appended claims.

What is claimed is:

1. A reversible refiner plate assembly for a disk-type refiner which includes a stator and a rotor having opposing faces, comprising, (a) an annular refiner plate having a working surface on each side thereof composed of alternating bars and grooves, (b) said refiner plate having locating grooves on the sides thereof, (c) means on one of said opposing faces of said stator and rotor defining a seat for said refiner plate and including lugs projecting axially from said seat in position to be received in said locating grooves, (d) means for releasably clamping said plate on said seat with each of said lugs received in one of said locating grooves and with one of said working surfaces facing said seat and the other said working surfaces exposed for use, or with one said surface thereof worn away and facing said seat and the other said working surface exposed for use, (e) the axial dimensions of said lugs and said locating grooves being proportioned to maintain said bars out of contact with the surface of said face between said lugs with said plate in said clamped relation with said seat, and (f) said lugs comprising cylindrical flanges cooperating with said locating grooves to close the ends of said grooves in said one working surface facing said seat to prevent bypass flow of stock between said one working face and said seat.

2. A refiner plate assembly as defined in claim 1 further comprising a spacer member having said lugs thereon and secured to said face by said clamping means.

* * * * *